US007084348B2

(12) United States Patent
Dillon

(10) Patent No.: US 7,084,348 B2
(45) Date of Patent: Aug. 1, 2006

(54) PLENUM COMMUNICATION CABLES COMPRISING POLYOLEFIN INSULATION

(75) Inventor: Scott Dillon, Woodstock, GA (US)

(73) Assignee: Superior Essex Communications LP, Atlanta, GA (US)

( * ) Notice: Subject to any disclaimer, the term of this patent is extended or adjusted under 35 U.S.C. 154(b) by 77 days.

(21) Appl. No.: 10/371,417

(22) Filed: Feb. 20, 2003

(65) Prior Publication Data

US 2004/0163839 A1 Aug. 26, 2004

(51) Int. Cl.
*H01B 7/00* (2006.01)

(52) U.S. Cl. ..... 174/113 R; 174/120 R

(58) Field of Classification Search ..... 174/113 R, 174/120 R, 121 A, 110 PM, 27
See application file for complete search history.

(56) References Cited

U.S. PATENT DOCUMENTS 5,270,486 A * 12/1993 Chan et al. ..... 174/23 R
5,525,757 A * 6/1996 O'Brien ..... 174/121 A
5,763,823 A * 6/1998 Siekierka et al. ..... 174/27
5,841,072 A * 11/1998 Gagnon ..... 174/110 F
5,841,073 A * 11/1998 Randa et al. ..... 174/113 R
6,392,152 B1 * 5/2002 Mottine et al. ..... 174/110 PM
6,495,760 B1 * 12/2002 Castellani et al. ..... 174/110 R
2002/0088641 A1 * 7/2002 Murga et al. ..... 174/120 R

* cited by examiner

*Primary Examiner*—Chau N. Nguyen
(74) *Attorney, Agent, or Firm*—King & Spalding LLP

(57) ABSTRACT

A plenum cable for transmitting various communication signals is described. The cable contains a plurality of twisted pairs of insulated conductors with an insulation that contains substantially no FEP or fluoropolymers. Rather, the insulation contains one or more layers containing an polyolefin material and the outermost layer comprises a flame-retardant polyolefin material. The cable can use a standard plenum-grade PVC jacket. Using this design for the cable lowers the cost by eliminating FEP while using a standard, plenum-grade PVC jacket that requires no modifications.

1 Claim, 3 Drawing Sheets

PLENUM COMMUNICATION CABLES COMPRISING POLYOLEFIN INSULATION

FIELD OF THE INVENTION

This invention generally relates to voice, video and data communication cables. More particularly, the invention relates to communication cables containing copper twisted pairs. Even more particularly, this invention relates to plenum data cables containing insulation typically made without flouropolymer-based materials.

BACKGROUND OF THE INVENTION

Communication cables are generally used to transmit a variety of signals, including voice, video, and data signals. Each cable typically contains a single or multiple strands of a transmission media (e.g., copper wire) coated with an insulating material. The strands of the insulated transmission media are generally contained within a hollow core of a tubular jacket. The insulating material, often called the insulation, confines the signals to the transmission media during transmission. While the jacket can be electrically insulating, its main purpose is to provide mechanical and environmental protection.

In addition to exhibiting many other characteristics, it is often necessary that communication cables exhibit fire resistance. When installed in buildings, communication cables are often routed through the ductwork of the building's air exchange system. Such cables are called plenum cables. To reduce the risk of fire propagating through the building's ductwork, safety codes often require that plenum cables meet industry standards for low smoke generation and low flame spread.

One type of plenum cable often used in voice and data communication systems of commercial buildings is an UTP (unshielded twisted pair) cable. There are several industry standards for these types of cables, including the NFPA 262 requirement and the electrical transmission requirements as defined in ANSI/TIA/EIA 568-B.2. Generally, UTP types of cable contain four individually twisted wire pairs comprised of 24 AWG copper conductors. Each wire is individually insulated with an insulation material.

Conventional insulation materials include thermoplastic polymers that are solid at operation temperatures, but soften and flow upon application of heat and pressure. The most common thermoplastic polymer in plenum cables is fluorinated ethylene-1-propylene copolymer (FEP). See, for example, U.S. Pat. Nos. 5,841,072, 5,841,073, and 5,563,377, the disclosures of which are incorporated herein by reference.

Current plenum cable designs have 3 general types of constructions. First, the cable insulation contains only FEP and is expensive to produce due to the cost of FEP. Second, the cable is a composite of FEP and other materials. See, for example, U.S. Pat. Nos. 5,841,073, 5,932,847, and 5,841,072, the disclosures of which are incorporated herein by reference. Third, the cable replaces the FEP with other polymers, but modifies the jacket of the cable significantly to compensate for the loss of insulation properties from the FEP. See, for example, U.S. Pat. No. 6,392,152 the disclosure of which is incorporated herein by reference.

Unfortunately, none of these conventional insulating materials or configurations is completely satisfactory. For example, FEP materials are quite expensive. Designs consisting of a composite of FEP and non-FEP materials often require twist length or expansion consideration to minimize signal propagation delay skew. As well, producing a cable with multiple insulation constructions increases manufacturing complexity and product cost. Using jacket materials to compensate for the reduced fire performance of the insulated conductors is also an expensive alternative. Typically, jackets used in such constructions are PVDF or PVC/PVDF alloys.

SUMMARY OF THE INVENTION

The invention provides a plenum cable for transmitting various communication signals. The cable contains a plurality of twisted pairs of insulated conductors with an insulation that contains substantially no FEP or fluoropolymers. Rather, the insulation contains one or more layers containing an polyolefin material and the outermost layer comprises a flame-retardant polyolefin material. The cable can use a standard plenum-grade PVC jacket. Using this design for the cable lowers the cost by eliminating FEP while using a standard, plenum-grade PVC jacket that requires no modifications.

The invention includes a communication cable comprising a jacket defining a core where the jacket comprises PVC, and a plurality of insulated conductors within the core, where the insulation for a conductor comprises substantially no fluoropolymers. The invention also includes a plenum cable comprising a jacket defining a core where the jacket comprises PVC, and a plurality of insulated conductors within the core, where the insulation for a conductor comprises substantially no fluoropolymers. The invention further includes a plenum cable, comprising a jacket defining a core, where the jacket comprises PVC, and a plurality of insulated conductors within the core, wherein the insulation for every conductor comprises substantially no fluoropolymers. The invention still further includes a plenum cable comprising a jacket defining a core where the jacket comprises PVC, and a first insulated conductor and a second insulated conductor twisted together within the core, wherein the insulation comprises an polyolefin material. The invention yet further includes communication systems containing such cables.

The invention also embraces a method of making a plenum cable by providing a conductor, providing insulation over the conductor, the insulation comprising substantially no fluoropolymers, and then providing a jacket over the insulated conductor, the jacket comprising PVC. The invention also embraces a method for communicating by providing a cable comprising a jacket defining a core, the jacket comprising PVC, and a plurality of insulated conductors within the core, wherein the insulation for a conductor comprises substantially no fluoropolymers, and then transmitting a signal over the cable.

BRIEF DESCRIPTION OF THE DRAWINGS

FIGS. 1–5 are views of several aspects of the communication cables and methods for making and using the same according to the invention, in which:

FIG. 1 shows a side view of a plenum cable in one aspect of the invention;

FIG. 2 shows a view of a twisted pair in one aspect of the invention;

FIG. 3 depicts a perspective view of a plenum cable in one aspect of the invention;

FIG. 4 shows a side view of an insulated conductor in one aspect of the invention; and FIG. 5 shows a side view of an insulated conductor in one aspect of the invention. FIGS. 1–5 illustrate specific aspects of the invention and are a part of the specification. Together with the following description, the figures demonstrate and explain the principles of the invention and are views of only particular—rather than complete—portions of the invention.

DETAILED DESCRIPTION OF THE INVENTION

The following description provides specific details in order to provide a thorough understanding of the invention. The skilled artisan, however, would understand that the invention can be practiced without employing these specific details. Indeed, the present invention can be practiced by modifying the illustrated system and method and can be used in conjunction with apparatus and techniques conventionally used in the industry. For example, the invention is described below for plenum cables, such as 4/24 CAT 5E cable as defined in ANSI/TIA/EIA 568 B.2 compliant with NFPA 262, but could be used in non-plenum cables or even in cables with different transmission requirements.

As noted above, the cable of the invention contains a plurality of twisted pairs of insulated conductors with an insulation that contains substantially no FEP or fluoropolymers. Instead, the insulation contains one or more layers containing a polyolefin material and the outermost layer comprises a flame-retardant polyolefin material. In one aspect, the invention is used in the plenum cable illustrated in FIG. 1. Of course, the invention could be used in various other plenum cables, so long as the plenum cable uses an insulation material.

Figure 1:
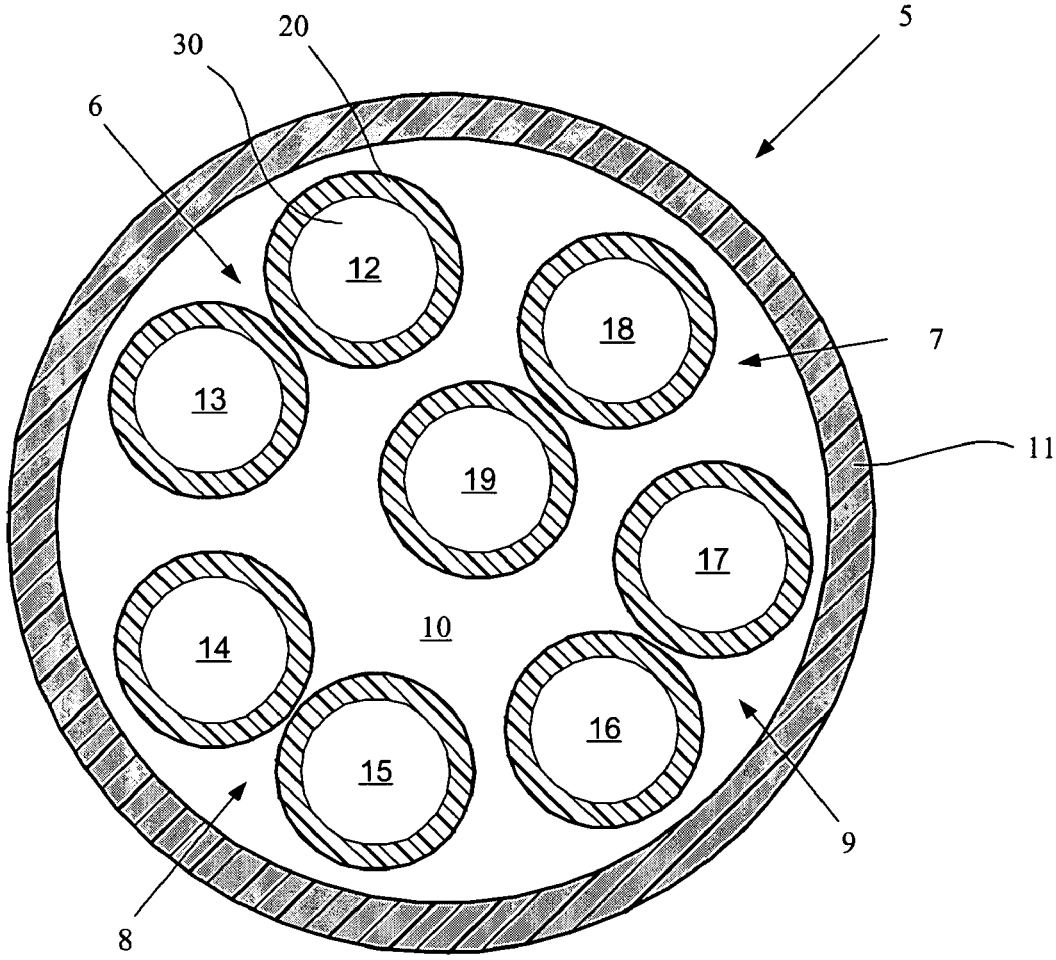

In FIG. 1, a cable 5 contains a core 10 contained within a jacket 11. The cable 5 is substantially rectangular, cylindrical, or tubular in shape. In one aspect of the invention, the shape of cable 5 is substantially cylindrical. The core 10 is generally hollow, but can be optionally filled with separators, binders, ripcords and/or tapes if desired.

Core 10 contains plurality of insulated conductors 12, 13, 14, 15, 16, 17, 18, and 19. Each insulated conductor contains a conductor 30 surrounded by an insulator 20. Each insulated conductor is twisted with another insulated conductor to form a twisted pair (respectively, 6, 7, 8, and 9, see also FIG. 3) of insulated conductors. The twisted pairs are then bunched together to form a bundle of twisted pairs contained within the jacket 11.

The term "conductor" as used herein refers to the current-carrying component of the cable 5. Typically, the conductor 30 comprises a single or multi-strand metal filament that is coated with the insulating material. The conductor 30 can be made of any electrically conducting material such as metal and metal alloys, but is typically made of copper or a copper alloy.

The insulator 20 confines the electrical signals to the conductor 30 during signal transmission. Thus, the insulator 20 can be fabricated from a wide variety of materials serving this function, including uncurable, thermoset, and thermoplastic polymers. Examples of suitable thermoplastic polymers include polyvinyl chloride (PVC), and various polyolefins, such as polyethylene, polypropylene, and/or combinations of these materials. If necessary, and especially for the outermost layer of the insulation, the thermoplastic polymer can contain compatible fire retardant additives (such as fillers) that minimize smoke generation and flame spread, such as phosphonate compounds.

In one aspect of the invention, the insulator 20 is fabricated without any fluoropolymer-based materials. These materials include thermoplastic polymers containing fluorine as a constituent, such as ethylene chlorotrifluoroethylene copolymer (ECTFE) and FEP. In one aspect of the invention, the plenum cable is constructed with insulation containing substantially no amounts of FEP. Rather than FEP, other fire-resistant polymers (such as those listed above) are used.

The types and amounts of the fire-resistant polymers that are used depend on the cable transmission requirements, safety standards, physical performance, the desired insulation properties, and cost considerations. In one aspect of the invention, polypropylene and polyethylene are used as the fire-resistant polymers. The amount of polypropylene can range from about 50 to about 100 wt % and the amount of polyethylene can range up to about 50 wt % of the insulation. In another aspect of the invention, the amount of polypropylene can range from about 65 to about 85 wt % and the amount of polyethylene can range from about 15 to about 35 wt % of the insulation.

In one aspect of the invention, the insulator is a single layer insulation comprising polypropylene. In this aspect of the invention, the polypropylene has been modified for increased fire resistance, such as PolyOne ECCOH 0521-48 and Equistar FR-2000. As well, the polypropylene can be physically or chemically foamed as described herein. The size of this layer depends on the degree of insulation needed, as well as other necessary physical characteristics, and can often range from about 0.003 to about 0.013 inches.

Figure 4:
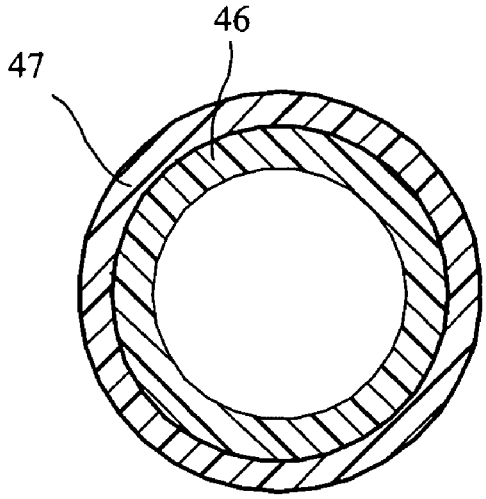

In another aspect of the invention, as shown in FIG. 4, the insulator is a dual layer insulation comprising polypropylene and polyethylene. In this aspect of the invention, the dual layer contains an inner layer 46 comprising a polyethylene and an outer layer 47 comprising polypropylene. The inner layer 46 in this aspect of the invention typically comprises a foamed polyethylene, such as Dow DGDA-3487. The foamed polyethylene can be either chemically or physically foamed. The outer layer 47 comprises a polypropylene material that has been modified for increased fire resistance as described above.

The size of the inner layer 46 and outer layer 47 in this aspect of the invention also depends on the degree of insulation needed, as well as other physical characteristics needed from the insulation. In one aspect of the invention, the outer layer 47 can range from about 0.001 to about 0.005 inch in thickness and the inner layer 46 can range from about 0.002 to about 0.007 inch in thickness. In another aspect of the invention, the outer layer 47 can range from about 0.003 to about 0.005 inch in thickness and the inner layer 46 can range from about 0.0015 to about 0.007 inch in thickness.

Figure 5:
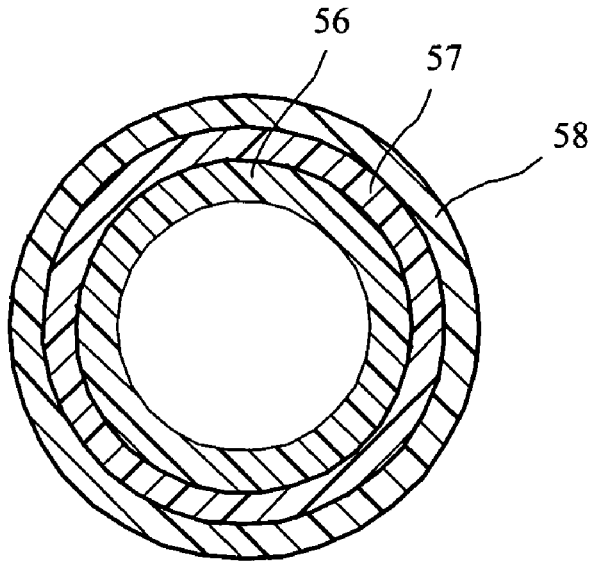

In yet another aspect of the invention, as shown in FIG. 5, the insulator contains three (or even more) layers comprising polyethylene and polypropylene materials. In this aspect of the invention, the inner layer 56 can comprise a material that adds significant strength to the design without degrading the transmission properties (e.g., a solid or low-foamed polyolefin material), the middle layer 57 comprises foamed polyethylene, and the outer layer 58 comprises polypropylene. As well, the outer layer 58 can also comprise other non-FEP thermoplastic materials such as flame-retardant polyolefin materials.

In this aspect of the invention, the degree of the expansion of the foamed polyolefin material and polyethylene depends on the desired insulation and physical properties needed. In one aspect of the invention, the polyolefin material in the inner layer 56 can have a degree of expansion ranging up to about 15% and the polyethylene in the middle layer 57 can have a degree of expansion ranging up to about 70%. In another aspect of the invention, the polyolefin material in the inner layer 56 can have a degree of expansion ranging up to about 5%, although in most instances it is not expanded and the polyethylene in the middle layer 57 can have a degree of expansion ranging from about 30% to about 70%. Optionally, the outer layer 58 can have a degree of expansion up to about 30%, although in most instances it is not expanded.

Again, the size of the various layers in this aspect of the invention depends on the degree of insulation needed, as well as other physical characteristics needed from the insulation. In one aspect of the invention, the outer layer 58 can range from about 0.0015 to about 0.005 inch in thickness, the middle layer 57 can range up to about 0.01 inch in thickness, and the inner layer 56 can range up to about 0.004 inch in thickness. In another aspect of the invention, the outer layer 58 can range from about 0.0005 to about 0.010 inch in thickness, the middle layer 57 can range from about 0.003 to about 0.006 inch in thickness, and the inner layer 56 can range from about 0.0005 to about 0.0015 inch in thickness.

In the aspects of the invention described above, the insulated pairs with FEP insulation can be used in combination with other known insulated pairs. In other words, a single twisted pair is formed using the insulation described above. Then, the single twisted pair is combined with other conventional twisted pairs (i.e., FEP, dual layer FEP/polyolefin, mixed pairs, etc . . . ) to make the plenum cable.

Figure 2:
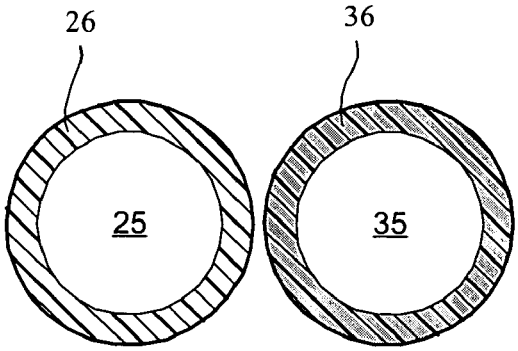
Figure 3:
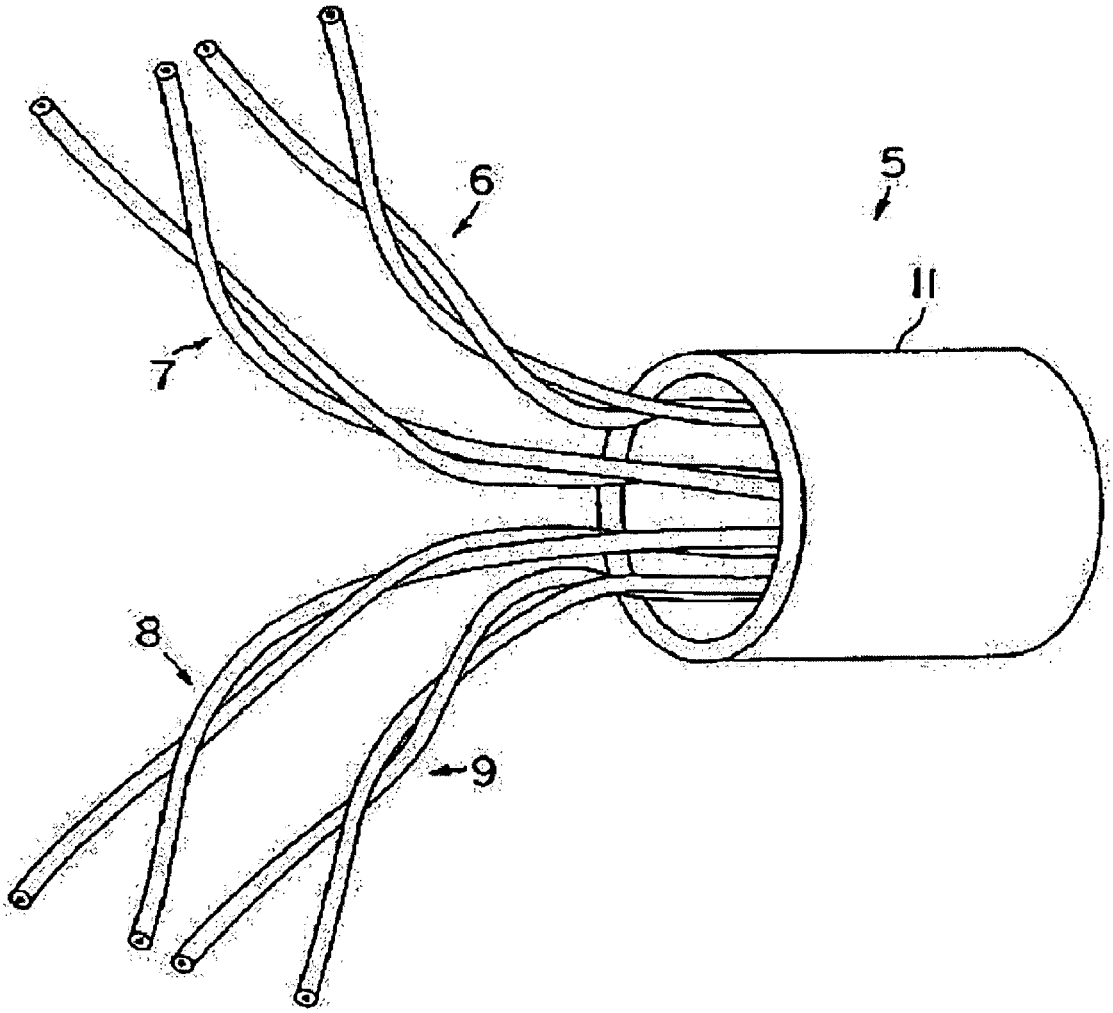

In one aspect of the invention, a twisted pair is formed from a combination of the insulating materials described above. In this aspect of the invention, a first insulation material is made using polyethylene and a second insulation material is made using polypropylene. For example, as shown in FIG. 2, the first insulation material can be used as the insulator 26 for a first conductor 25 and the second insulation material can be used as the insulator 36 for a second conductor 35. Then, the insulated first conductor 25 and the insulated second conductor 35 are twisted together to form a twisted pair, e.g., twisted pair 6 as shown in FIG. 3. If desired, other thermoplastic polymers (but not FEP) can be added to first and/or second insulation material before it is used as the first or second insulator.

In another aspect of the invention, a hybrid of the above methods could be used. In this aspect of the invention, a single twisted pair (9) could use both of the above methods. For example, a first insulated conductor 25 could contain an insulator 26 made from the polyethylene and polypropylene materials. A second conductor 35 could contain an insulator 36 made from conventional materials. Both the first and the second conductors could then be used in a twisted pair (9) of a communication cable 5.

In the invention, the communication cable 5 can also contain a binder and/or a ripcord. The binder serves to contain or confine the transmission medium along part or all of the length of the communication cable. Several types of binders are known in the art (helical, longitudinal, or counter-helical wound) and can be used in the communication cables of the invention.

The communication cable of the invention may also contain a ripcord. The ripcord serves to provide access to the core of the communication cable by separating the jacket 11. For example, one can grasp an end of the ripcord and pull it outward away from an outer surface of the jacket 11, thereby splitting the jacket 11 and exposing the core 10. Any configuration for the ripcord that achieves this function can be employed in the invention.

The jacket 11 is also electrically insulating, even though its main purpose is to provide mechanical and environmental protection. Thus, the cable jacket 11 can be fabricated from a wide variety of materials serving this function, including uncurable, thermoset, and thermoplastic polymers. Examples of thermoplastics polymers include those listed above, as well as those known in the art. In one aspect of the invention, a low-smoke PVC material is used in the jacket. In another aspect of the invention, such as where the cable is used in a Riser application or cables with pair counts greater than 4, the jacket can be made with different PVC materials, PVDF, PVDF/PVC polymers, ETCFE, and other fluoropolymers. These materials can be solid or foamed.

The thickness of the jacket can be any thickness commonly used in plenum cables for the materials listed above. Typically, this thickness is less than about 40 mils. In one aspect of the invention, this thickness can range from about 20 to about 25 mils.

The insulating materials of the invention are not limited to merely being used in metallic conductor cables, like those illustrated in FIGS. 1–3. The insulating materials of the invention can also be used in hybrid cables that include both optical fibers and metallic conductors.

The plenum cables of the invention can be made as known in the art, with the exception of making the insulation with the materials as described above. Briefly, the conductor 30 is obtained and then the insulator 20 is provided on the conductor by any number of techniques, such as a polymer extrusion process. The desired pairs of conductors are then twisted together, and the twisted pairs are bundled together. Finally, the jacket is then provided on the bundle of conductors.

Having described these aspects of the invention, it is understood that the invention defined by the appended claims is not to be limited by particular details set forth in the above description, as many apparent variations thereof are possible without departing from the spirit or scope thereof.

I claim:

1. A communications cable having minimized smoke generation and flame spread, comprising:

a low-smoke PVC jacket defining a core region for housing a plurality of electrical conductors;

a plurality of twisted pair conductors disposed within said jacket at said core region;

said twisted pair conductors having an electrically conductive metal center and an insulation layer overlying and contacting said metal center;

said insulation layer of all of said plurality of said twisted pair conductors being formed of a polyolefin selected from the group consisting of polyethylene and polypropylene, and combinations thereof;

said insulation layer further including a flame retardant; and wherein said insulation layer is substantially free of fluoropolymer and said core region contains substantially no fluoropolymer; and wherein said insulation layer has an inner region contacting said electrically conductive metal center, a middle region overlying said inner region and an outer region overlying said middle region:

said inner region being formed of a polyolefin selected from the group consisting of solid polyolefins and foamed polyolefins;

said middle region being formed of foamed polyethylene;

said outer region being formed of unfoamed polypropylene modified to increase fire resistance wherein said outer region has a radial thickness of from about 0.0015 to about 0.005 inch, said middle region has a radial thickness of up to about 0.004 inch and said inner layer has a radial thickness of up to about 0.004 inch, and wherein polyethylene forms from about 15% by weight to about 35% by weight of said insulation layer and polypropylene forms from about 65% by weight to about 85% by weight of said insulation layer.

* * * * *

UNITED STATES PATENT AND TRADEMARK OFFICE

CERTIFICATE OF CORRECTION

PATENT NO. : 7,084,348 B2
APPLICATION NO. : 10/371417
DATED : August 1, 2006
INVENTOR(S) : Scott Dillon It is certified that error appears in the above-identified patent and that said Letters Patent is hereby corrected as shown below:

Claim 1, column 6, line 60, “region:” should read --region;--.

Signed and Sealed this

Twenty-eighth Day of November, 2006

JON W. DUDAS
*Director of the United States Patent and Trademark Office*